US011325140B2

(12) United States Patent
Horiuchi

(10) Patent No.: US 11,325,140 B2
(45) Date of Patent: May 10, 2022

(54) AIR TURBINE DRIVE SPINDLE

(71) Applicant: NTN CORPORATION, Osaka (JP)

(72) Inventor: Teruyoshi Horiuchi, Iwata (JP)

(73) Assignee: NTN CORPORATION, Osaka (JP)

( * ) Notice: Subject to any disclaimer, the term of this patent is extended or adjusted under 35 U.S.C. 154(b) by 561 days.

(21) Appl. No.: 16/328,510

(22) PCT Filed: Aug. 8, 2017

(86) PCT No.: PCT/JP2017/028809
§ 371 (c)(1),
(2) Date: Feb. 26, 2019

(87) PCT Pub. No.: WO2018/043071
PCT Pub. Date: Mar. 8, 2018

(65) Prior Publication Data

US 2020/0398292 A1 Dec. 24, 2020

(30) Foreign Application Priority Data

Aug. 30, 2016 (JP) ..... JP2016-168357

(51) Int. Cl.
*B05B 5/04* (2006.01)
*F01D 1/08* (2006.01)
(Continued)

(52) U.S. Cl.
CPC ..... *B05B 5/0415* (2013.01); *B05B 1/02* (2013.01); *F01D 1/02* (2013.01); *F01D 1/08* (2013.01); *F01D 15/06* (2013.01)

(58) Field of Classification Search
CPC ..... B05B 3/002; B05B 3/003; B05B 3/1007; B05B 3/1014; B05B 3/1035;
(Continued)

(56) References Cited

U.S. PATENT DOCUMENTS 4,447,008 A * 5/1984 Allen ..... B05B 15/555 239/214.13
6,050,499 A 4/2000 Takayama et al.
(Continued)

FOREIGN PATENT DOCUMENTS

CN 2770797 Y 4/2006
CN 101084069 A 12/2007
(Continued)

OTHER PUBLICATIONS

Chinese Office Action issued in corresponding Chinese Patent Application No. 201780052896.X, dated Mar. 3, 2021, with English translation.

(Continued)

*Primary Examiner* — Eldon T Brockman
*Assistant Examiner* — Brian O Peters
(74) *Attorney, Agent, or Firm* — McDermott Will & Emery LLP

(57) ABSTRACT

An air turbine drive spindle capable of suppressing a pressure increase inside a through hole is provided. A spindle includes a rotary shaft and an outer circumferential member (a housing assembly, a cover and a nozzle plate). The rotary shaft is provided with a through hole. The outer circumferential member includes a bearing sleeve configured to surround at least a portion of an outer circumferential surface of the rotary shaft. The outer circumferential member includes a gas supply portion and a gas exhaust hole. The spindle includes a second gas exhaust portion (a first gas exhaust hole and a first gas flow passage). The second gas exhaust portion is independent of the gas exhaust hole and continuous to outside from a gas exhaust space.

10 Claims, 10 Drawing Sheets

(51) Int. Cl.
*F01D 15/06* (2006.01)
*F01D 1/02* (2006.01)
*B05B 1/02* (2006.01)

(58) Field of Classification Search
CPC ..... B05B 3/1064; B05B 5/0415; F01D 1/02; F01D 1/08; F01D 15/00; F01D 15/065
See application file for complete search history.

(56) References Cited

U.S. PATENT DOCUMENTS

| | | | |
|---|---|---|---|
| 2004/0164190 | A1 | 8/2004 | Baumann et al. |
| 2013/0042608 | A1 | 2/2013 | Sun et al. |
| 2014/0166255 | A1 | 6/2014 | Bogue et al. |
| 2014/0217205 | A1 | 8/2014 | Kobayashi et al. |
| 2015/0217306 | A1 | 8/2015 | Matsumoto |

FOREIGN PATENT DOCUMENTS

| | | | |
|---|---|---|---|
| CN | 102639816 | A | 8/2012 |
| CN | 202926405 | U | 5/2013 |
| CN | 203730560 | U | 7/2014 |
| JP | H06313428 | A | 11/1994 |
| JP | H09995 | A | 1/1997 |
| JP | H09285742 | A | 11/1997 |
| JP | H10-216567 | A | 8/1998 |
| JP | 2007-023783 | A | 2/2007 |
| JP | 2014-113562 | A | 6/2014 |
| WO | 2006/024861 | A1 | 3/2006 |
| WO | 2015/004966 | A1 | 1/2015 |

OTHER PUBLICATIONS

International Search Report issued in International Application No. PCT/JP2017/028809, dated Oct. 3, 2017.

Japanese Office Action issued in corresponding Japanese Patent Application No. 2016-168357, dated Aug. 18, 2020, English translation.

* cited by examiner

AIR TURBINE DRIVE SPINDLE

CROSS REFERENCE

This application is a U.S. National Phase under 35 U.S.C. § 371 of International Application No. PCT/JP2017/028809, filed on Aug. 8, 2017 which claims the benefit of Japanese Application No. 2016-168357, filed on Aug. 30, 2016, the entire contents of both are hereby incorporated by reference.

TECHNICAL FIELD

The present invention relates to an air turbine drive spindle applied to a precision processing machine, an electrostatic coating apparatus, or the like.

BACKGROUND ART

Conventionally, an air turbine drive spindle (which will be hereinafter also simply referred to a spindle) used for a precision processing machine or an electrostatic coating apparatus has been known. For example, WO2015/004966 (PTL 1) discloses a spindle for coating machine. The spindle for coating machine as disclosed in PTL 1 drives the rotary shaft not by an electric motor but by an air turbine. Specifically, compressed air is emitted from a turbine nozzle and blown toward a rotor blade provided on the back end side of the rotary shaft, thereby driving the rotary shaft so as to be rotated.

The turbine air emitted from the turbine nozzle and flowing past the rotor blade flows from a turbine air exhaust passage adjacent to the rotor blade through a gas exhaust space. Then, the turbine air is exhausted to outside through a gas exhaust hole. This gas exhaust hole is in communication with the gas exhaust hole on the coating machine side. Thus, the turbine air is discharged through a gas exhaust pipe connected to the gas exhaust hole on the coating machine side to the outside of the coating machine.

In this case, a pipeline resistance occurs in the gas exhaust pipe. Thus, part of the turbine air does not flow through the gas exhaust pipe, but flows through a through hole of the rotary shaft continuous to the gas exhaust space and then reaches the inside of the cup placed at the leading end portion of the rotary shaft. The pressure inside the gas exhaust space and the through hole at this time is higher than the atmospheric pressure. Also, this pressure rises as the flow rate of the turbine air increases.

The cup placed at the leading end portion of the rotary shaft serves to spread the coating material sprayed from the coating material spray nozzle disposed inside the through hole of the rotary shaft with centrifugal force such that the coating material is atomized. Then, when the turbine air reaches the inside of the cup as described above to raise the pressure inside the cup, this pressure pushes out the coating material, which causes a problem that the coating material cannot be uniformly atomized.

The above-mentioned PTL 1 discloses a configuration in which a gas exhaust hole is formed on the leading end portion side of the rotary shaft so as to extend from the inside of the through hole of the rotary shaft to the side surface on the outer circumferential of the rotary shaft in order to suppress the pressure increase inside the through hole of the rotary shaft as described above.

CITATION LIST

Patent Literature

PTL 1: WO2015/004966

SUMMARY OF INVENTION

Technical Problem

However, in the configuration in which a gas exhaust hole is formed on the leading end portion side of the rotary shaft as described above, the gas exhaust hole is located close to the cup at the leading end portion of the rotary shaft. Accordingly, for example, when the pressure inside the through hole greatly increases, uniform atomization of the coating material in the cup may be inhibited.

The present invention has been made to solve the above-described problems. An object of the present invention is to provide an air turbine drive spindle capable of suppressing an increase in pressure inside a through hole.

Solution to Problem

An air turbine drive spindle according to the present invention includes a rotary shaft and an outer circumferential member. The rotary shaft is provided with a through hole. The rotary shaft includes: a leading end portion; a base end portion located opposite to the leading end portion; and a plurality of rotor blades disposed at the base end portion along a rotation direction of the rotary shaft. The outer circumferential member includes a bearing sleeve configured to surround at least a portion of an outer circumferential surface of the rotary shaft. The outer circumferential member includes a gas supply portion and a first gas exhaust portion. The gas supply portion is configured to spray gas onto each of the plurality of rotor blades so as to rotate the rotary shaft. The first gas exhaust portion is configured to discharge the gas sprayed onto each of the plurality of rotor blades from a gas exhaust space facing each of the plurality of rotor blades to outside of the outer circumferential member. The gas exhaust space is continuous to the through hole. The air turbine drive spindle includes a second gas exhaust portion. The second gas exhaust portion is independent of the first gas exhaust portion, and is continuous to the outside from at least one of the gas exhaust space and a gas exhaust region. The gas exhaust region is included in an internal space of the through hole and located close to the gas exhaust space relative to an end portion of the bearing sleeve that is located close to the leading end portion.

Advantageous Effects of Invention

According to the above description, it becomes possible to suppress an increase in pressure inside a through hole of a rotary shaft in an air turbine drive spindle.

DESCRIPTION OF EMBODIMENTS

Figure 1:
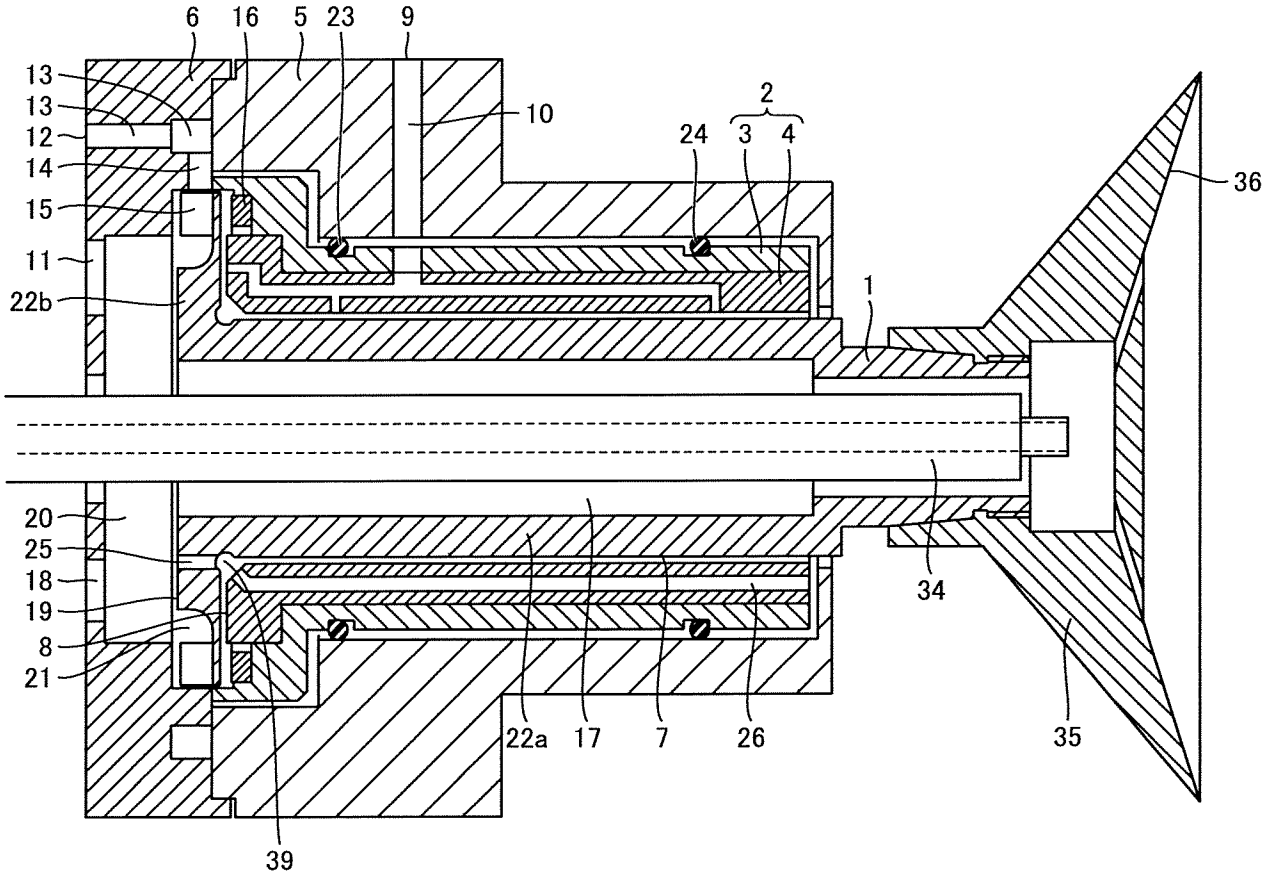
FIG. 1 is a schematic cross-sectional view of a spindle according to the first embodiment of the present invention.

The embodiments of the present invention will be hereinafter described with reference to the accompanying drawings, in which the same or corresponding components are designated by the same reference characters, and description thereof will not be repeated.

First Embodiment

<Configuration of Spindle>

Referring to FIGS. 1 to 4, a spindle according to the present embodiment will be hereinafter described. The spindle shown in each of FIGS. 1 to 4 is an air turbine drive spindle.

The spindle mainly includes: a rotary shaft 1; a journal bearing 7 configured to support rotary shaft 1 in the radial direction; a thrust bearing 8 configured to support rotary shaft 1 in the thrust direction; a housing assembly 2 configured to rotatably support rotary shaft 1 using journal bearing 7 and thrust bearing 8; a cover 5 located on the outer circumferential side of housing assembly 2; a back end side O ring 23 and a leading end side O ring 24 that are disposed between cover 5 and housing assembly 2; and a gas supply portion provided to be capable of spraying gas onto rotary shaft 1 (a driving gas supply passage 13 and a driving gas supply nozzle 14). A nozzle plate 6 is fixedly provided in cover 5 so as to cover rotary shaft 1 in the thrust direction. Nozzle plate 6 is provided with the above-mentioned gas supply portion. Each of journal bearing 7 and thrust bearing 8 is configured as a static pressure gas bearing, for example.

Rotary shaft 1 includes: a shaft portion 22*a* having a cylindrical shape; and a thrust plate portion 22*b* formed to extend in the radial direction relative to shaft portion 22*a*. Thrust plate portion 22*b* is connected to one end portion of shaft portion 22*a* in the axial direction. In the description below, the back side represents the side of the above-mentioned one end portion of shaft portion 22*a* on which the thrust plate portion is provided in the axial direction, whereas the front side represents the side of the other end portion of shaft portion 22*a* opposite to thrust plate portion 22*b* in the axial direction of shaft portion 22*a*.

Shaft portion 22*a* and thrust plate portion 22*b* each are provided with a through hole 17 extending in the thrust direction. When the spindle is configured to be used for an electrostatic coating apparatus, a cup 35 having a cup surface 36 formed in a conic shape is attached to the end portion of rotary shaft 1 on the front side, as shown in FIG. 1. Inside through hole 17, a coating material spray nozzle 34 for supplying a coating material to cup 35 is disposed. Thrust plate portion 22*b* is provided with: a rotor blade 15; and a rotation detection portion 19 disposed on the inner circumferential side relative to rotor blade 15.

Rotary shaft 1 is configured such that a part of shaft portion 22*a* is housed in housing assembly 2. Housing assembly 2 includes a bearing sleeve 4 formed to surround a part of shaft portion 22*a* and to face a part of the outer circumferential surface of shaft portion 22*a* of rotary shaft 1 and a part of the flat plane of thrust plate portion 22*b* on the front side. Furthermore, housing assembly 2 includes a housing 3 disposed on the outer circumferential side relative to bearing sleeve 4 in the radial direction and fixed to bearing sleeve 4.

Figure 2:
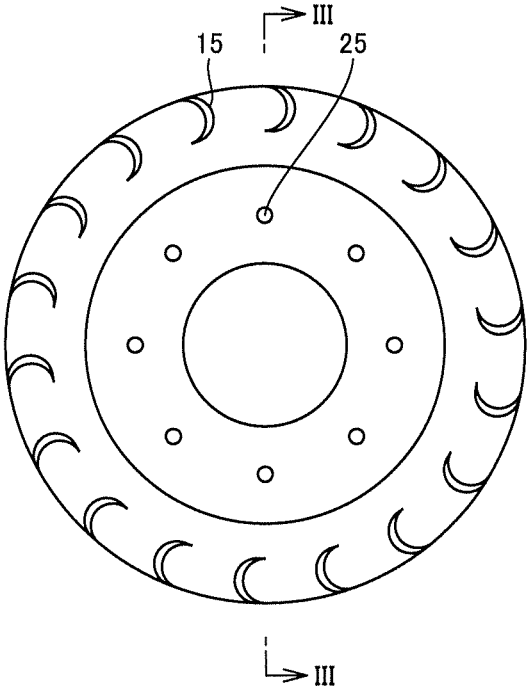
FIG. 2 is a schematic plan view of the spindle shown in FIG. 1.
Figure 3:
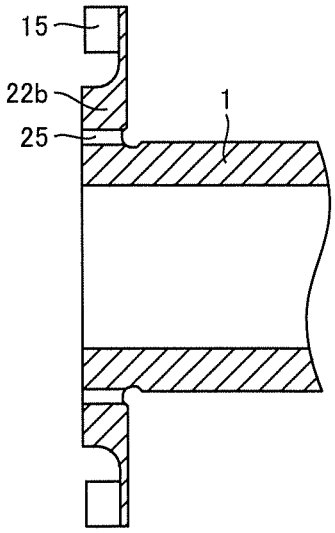
FIG. 3 is a partial schematic cross-sectional view taken along a line in FIG. 2.

In rotary shaft 1, a first gas exhaust hole 25 is provided as a pressure release hole that extends through thrust plate portion 22*b* from its surface on the back side to its surface on the front side. As shown in FIGS. 2 and 3, a plurality of first gas exhaust holes 25 may be provided in thrust plate portion 22*b*. First gas exhaust holes 25 may be annularly arranged in thrust plate portion 22*b*. The plurality of first gas exhaust holes 25 may be arranged at regular intervals from each other.

A bearing gas exhaust space 39 is provided in a portion that faces the region of the end opening of first gas exhaust hole 25 in the surface of thrust plate portion 22*b* on the front side so as to be adjacent to housing assembly 2. Inside housing assembly 2, a first gas flow passage 26 as a bearing gas exhaust passage is provided so as to be continuous to bearing gas exhaust space 39. First gas flow passage 26 is provided inside bearing sleeve 4 constituting housing assembly 2. First gas flow passage 26 is formed so as to extend through bearing sleeve 4 from the surface portion facing bearing gas exhaust space 39 to the surface portion located on the front side of rotary shaft 1.

For example, housing assembly 2 is configured such that housing 3 is connected to cover 5 through back end side O ring 23 and leading end side O ring 24. Leading end side O ring 24 is located in the leading end side region close to the leading end of rotary shaft 1 relative to the center of bearing sleeve 4 in the direction along the rotation center axis of rotary shaft 1. Back end side O ring 23 is located in the back end side region on the back end side of rotary shaft 1 relative to the center of bearing sleeve 4 in the direction along the rotation center axis. Back end side O ring 23 and leading end side O ring 24 each are disposed inside the annular groove formed on the surface of housing 3 so as to extend around the rotation center axis.

Leading end side O ring 24 and back end side O ring 23 are suitably made of a material highly resistant to a solvent, for example. Examples of this material may be perfluoroelastomer as a fluorine-based resin.

Furthermore, as shown in FIG. 1, in thrust plate portion 22*b* of rotary shaft 1, a region located on the outer circumferential side in the radial direction has a thin portion thinner in thickness in the thrust direction than a region (thick portion) located on the rotation center axis side (center side).

The thick portion is formed to surround through hole 17. The thin portion is formed to surround the thick portion.

Rotor blade 15 is formed to extend in the thrust direction from a surface of the thin portion of thrust plate portion 22*b* located on the back side. Rotary shaft 1 is provided to be rotatable when rotor blade 15 receives gas emitted from the gas supply portion. A plurality of rotor blades 15 are provided to be spaced apart from one another in the rotation direction of rotary shaft 1. Preferably, adjacent rotor blades 15 of the plurality of rotor blades 15 are provided at regular intervals. The plurality of rotor blades 15 are disposed along the outer circumference of thrust plate portion 22*b*. The cross sectional shape of each of the plurality of rotor blades 15 perpendicular to the thrust direction may be any shape. For example, this cross sectional shape of rotor blade 15 has: a front curved portion located on the front side in the rotation direction and formed to protrude in the rotation direction; and a backside curved portion located on the back side in the rotation direction and formed to protrude in the rotation direction.

As shown in FIG. 1, in thrust plate portion 22*b*, the boundary region between the thin portion and the thick portion is provided to gradually change in thickness in the thrust direction. That is, the surface of thrust plate portion 22*b* on the back side has a curved surface between the thin portion and the thick portion. A portion of rotor blade 15 on the back side and a portion of the thick portion on the back side are formed on the same plane extending in the radial direction.

On the surface of the thick portion located on the back side, rotation detection portion 19 is formed. Rotation detection portion 19 may be formed in any configuration for optically detecting the rotation of rotary shaft 1. For example, rotation detection portion 19 may be surface-treated to have different reflectances for each of a plurality of regions divided in the rotation direction. Specifically, in the surface of the thick portion on the back side, a half region in the rotation direction of rotary shaft 1 is provided to have intensity higher in reflected light than the other half region under irradiation with light such as laser light.

Cover 5 and housing assembly 2 formed of housing 3 and bearing sleeve 4 are formed to have a bearing gap between shaft portion 22*a* of rotary shaft 1 and bearing sleeve 4 and a bearing gap between thrust plate portion 22*b* and bearing sleeve 4. Furthermore, housing assembly 2 and cover 5 are provided to be capable of supplying gas to the bearing gaps. Specifically, housing assembly 2 and cover 5 have their respective bearing gas supply passages 10 that are connected to each other. Bearing gas supply passages 10 each have: one end connected to bearing gas supply port 9 on the outer circumferential surface of cover 5; and the other end connected to a corresponding one of the bearing gap between shaft portion 22*a* of rotary shaft 1 and bearing sleeve 4 and to the bearing gap between thrust plate portion 22*b* of rotary shaft 1 and bearing sleeve 4. A portion of bearing gas supply passage 10 that is connected to the bearing gap is smaller in hole size than bearing gas supply port 9. In this portion of bearing gas supply passage 10 that is connected to the bearing gap, a so-called narrowed portion is formed. Journal bearing 7 is formed by supplying the gas from bearing gas supply port 9 via bearing gas supply passage 10 to the bearing gap between shaft portion 22*a* of rotary shaft 1 and bearing sleeve 4. Thrust bearing 8 is formed by: the pressing force generated by supplying the gas from bearing gas supply port 9 via bearing gas supply passage 10 to the bearing gap between thrust plate portion 22*b* of rotary shaft 1 and bearing sleeve 4; and the attraction force of a magnet 16 (described later).

Magnet 16 is disposed in housing 3 in a region facing thrust plate portion 22*b* in the thrust direction. Magnet 16 is provided to apply magnetic force to thrust plate portion 22*b*. Magnet 16 is a permanent magnet, for example. Thereby, magnet 16 attracts thrust plate portion 22*b* with magnetic force. Magnet 16 is provided so as to face, in the thrust direction, the thin portion of thrust plate portion 22*b* provided with rotor blade 15, for example. Magnet 16 has a plane formed in an annular shape as seen in the thrust direction, for example.

Cover 5 is fixed to nozzle plate 6 in the thrust direction. Nozzle plate 6 is formed to surround portions (the outer circumferential end face of thrust plate portion 22*b* in the radial direction and the surface of thrust plate portion 22*b* on the back side) of rotary shaft 1 that are not accommodated in housing assembly 2 and cover 5.

Nozzle plate 6 is disposed on the back side relative to rotary shaft 1. On the inside of nozzle plate 6, a flow passage is formed, through which driving gas flows when the driving gas is supplied to/discharged from rotor blade 15 formed on thrust plate portion 22*b* of rotary shaft 1. The driving gas is compressed air, for example.

Nozzle plate 6 is provided with driving gas supply passage 13 and driving gas supply nozzle 14 through which the driving gas is supplied to rotor blade 15. Driving gas supply passage 13 has: one end connected to a turbine gas supply port 12 on the outer circumferential surface of nozzle plate 6; and the other end connected to driving gas supply nozzle 14. Driving gas supply nozzle 14 is provided to be capable of emitting the driving gas to rotor blade 15 in the radial direction from the outside of rotary shaft 1 toward the inside thereof. A plurality of driving gas supply passages 13 and a plurality of driving gas supply nozzles 14 may be formed with an interval therebetween in the rotation direction. In other words, driving gas supply passages 13 and driving gas supply nozzles 14 may be provided to allow the driving gas to be simultaneously supplied in the same rotation direction to rotor blades 15 provided in the rotation direction with an appropriate interval therebetween.

Nozzle plate 6 is provided with a driving gas exhaust space 20 and a gas exhaust hole 11, through which the driving gas supplied from driving gas supply nozzle 14 to rotor blade 15 is discharged to the outside of the spindle. Driving gas exhaust space 20 is formed between nozzle plate 6 and thrust plate portion 22*b*. A space 21 facing the back side of thrust plate portion 22*b* (the thin portion) and sandwiched between rotor blades 15 adjacent to each other is connected to driving gas supply nozzle 14 and driving gas exhaust space 20. Nozzle plate 6 is further provided with through holes. Nozzle plate 6 is provided with a through hole located at the center in the radial direction so as to be continuous to through hole 17 in the thrust direction.

Figure 4:
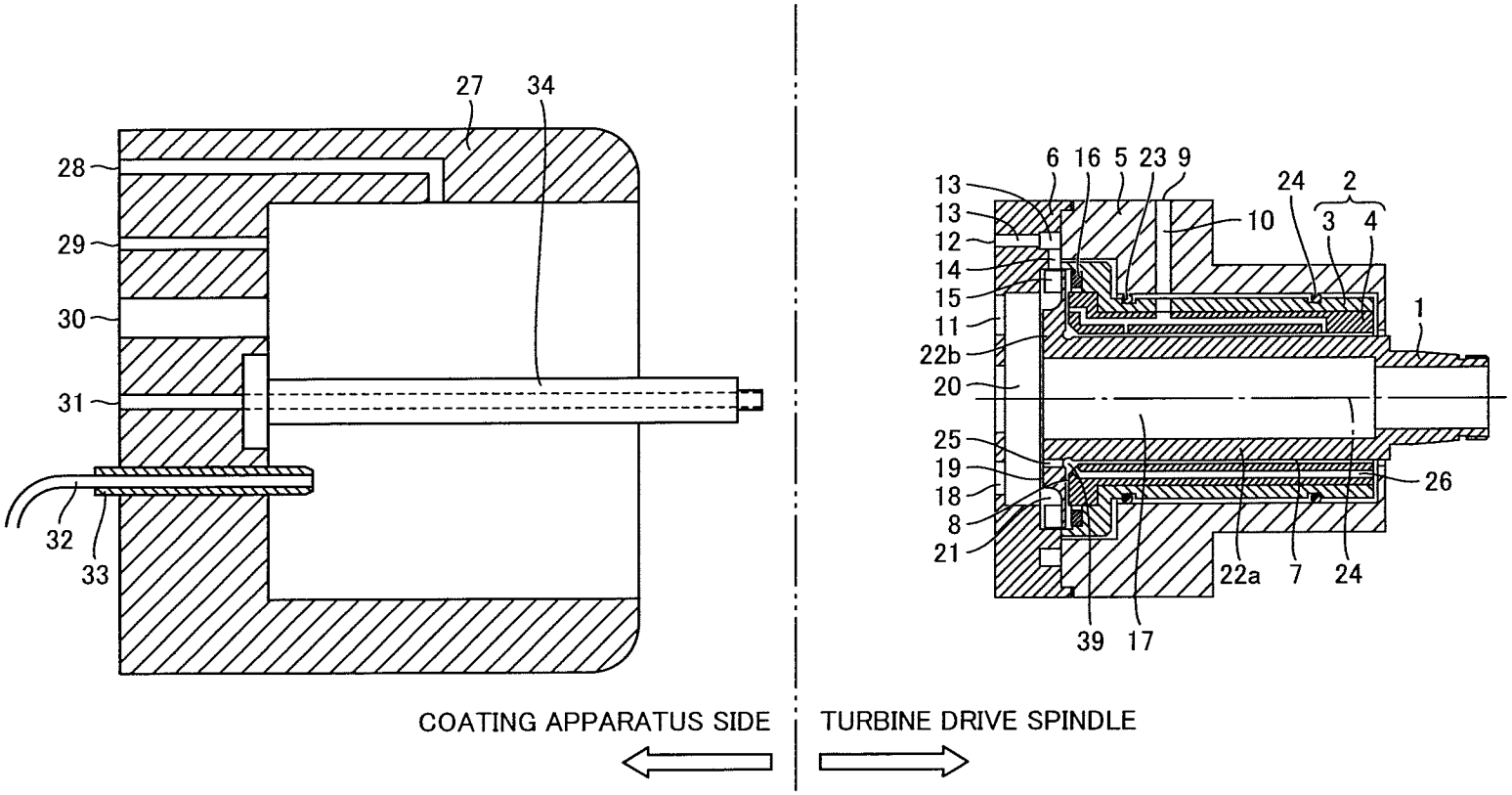
FIG. 4 is a schematic diagram illustrating the configuration in the case where the spindle shown in FIG. 1 is installed in a coating apparatus.

Nozzle plate 6 is also provided with a rotation sensor insertion port 18 on the outer circumferential side in the radial direction relative to the above-mentioned through hole. Rotation sensor insertion port 18 is formed to face, in the thrust direction, rotation detection portion 19 in thrust plate portion 22*b*. Rotation sensor insertion port 18 is formed such that a rotation sensor for emitting light such as laser light to rotation detection portion 19 and receiving reflected light is disposed therein. Example of such a rotation sensor may be an optical sensor 32 or the like that is placed in a spindle holder 27 on the coating apparatus side as an apparatus, for example, as shown in FIG. 4. As shown in FIG. 4, optical sensor 32 is housed in a cylindrical sensor holder 33 placed in spindle holder 27, for example. Together with this sensor holder 33, optical sensor 32 is inserted into rotation sensor insertion hole 18. By such a configuration, the rotating speed of rotary shaft 1 can be measured optically in the above-mentioned spindle.

Gas exhaust hole 11 is provided in nozzle plate 6 at the center side in the radial direction relative to driving gas supply passage 13 and driving gas supply nozzle 14. Gas exhaust hole 11 is formed to extend from gas exhaust space 20 to communicate with the outside of nozzle plate 6. Gas exhaust space 20 is provided in nozzle plate 6 between thrust plate portion 22*b* and gas exhaust hole 11.

The spindle as described above is installed in spindle holder 27 as shown in FIG. 4 to be used. Spindle holder 27 is provided with a recess portion into which the spindle is fixedly inserted. A coating material spray nozzle 34 is placed so as to protrude from the bottom portion of the recess portion. Spindle holder 27 is provided with a coating material supply hole 31 extending to the outer circumferential surface from the bottom surface on which coating material spray nozzle 34 is placed. Furthermore, the bottom portion of the recess portion in spindle holder 27 is provided with a gas exhaust hole 30 located to face gas exhaust hole 11 of the spindle. The bottom portion of the recess portion in spindle holder 27 is provided with a turbine gas supply port 29 on the spindle holder 27 side so as to face turbine gas supply port 12 of the spindle. Furthermore, spindle holder 27 is provided with a gas supply passage extending from the portion of the inner wall of the recess portion that faces bearing gas supply port 9 of the spindle to bearing gas supply port 28 of spindle holder 27.

<Operation of Air Turbine Drive Spindle>

Then, the operation of the spindle according to the present embodiment will be hereinafter described.

The driving gas supplied from the driving gas supply source such as an air compressor (not shown) is supplied from turbine gas supply port 12 via driving gas supply passage 13 to driving gas supply nozzle 14. The driving gas supplied to driving gas supply nozzle 14 is emitted toward rotor blade 15 of thrust plate portion 22*b* of rotary shaft 1 along the direction substantially parallel to the tangential direction (rotation direction) of thrust plate portion 22*b*. Rotor blade 15 receives the emitted driving gas at the backside curved portion. On this occasion, the driving gas emitted toward rotor blade 15 reaches the outer circumferential side of the backside curved portion, flows along the backside curved portion to be changed in direction, and then reaches gas exhaust space 20 from space 21 so as to be discharged through gas exhaust hole 11 to the outside. Rotor blade 15 receives reaction force of the force applied to the driving gas, and thrust plate portion 22*b* of rotary shaft 1 receives rotation torque. Thereby, rotary shaft 1 is rotated along the rotation direction. The rotating speed of rotary shaft 1 can be greater than or equal to several tens of thousands rpm, for example. In other words, the above-described spindle is suitable for a spindle for electrostatic coating apparatus, for example.

<Functions and Effects>

As a characteristic configuration of the above-described spindle, the spindle includes a rotary shaft 1 and an outer circumferential member (a housing assembly 2, a cover 5 and a nozzle plate 6). Rotary shaft 1 is provided with a through hole 17. Rotary shaft 1 includes: a leading end portion; a base end portion located opposite to the leading end portion; and a plurality of rotor blades 15 disposed at the base end portion along a rotation direction of rotary shaft 1. The outer circumferential member (housing assembly 2, cover 5 and nozzle plate 6) includes a bearing sleeve 4 configured to surround at least a portion of the outer circumferential surface of rotary shaft 1. The outer circumferential member includes a gas supply portion (a driving gas supply passage 13 and a driving gas supply nozzle 14) and a first gas exhaust portion (a gas exhaust hole 11). The gas supply portion is configured to spray gas onto rotor blade 15 in order to rotate rotary shaft 1. The first gas exhaust portion (gas exhaust hole 11) is configured to discharge the gas sprayed onto rotor blade 15 from a gas exhaust space 20 facing rotor blade 15 to outside of the outer circumferential member. Gas exhaust space 20 is continuous to through hole 17. The spindle includes a second gas exhaust portion (a first gas exhaust hole 25 and a first gas flow passage 26). The second gas exhaust portion is independent of the first gas exhaust portion (gas exhaust hole 11), and is continuous to outside from at least one of gas exhaust space 20 and the gas exhaust region. The gas exhaust region is included in an internal space of through hole 17 and located close to gas exhaust space 20 relative to an end portion of bearing sleeve 4 that is located close to the leading end portion. In the spindle, the second gas exhaust portion includes: at least one first gas exhaust hole 25 penetrating through a portion (a thrust plate portion 22*b*) of rotary shaft 1 that faces gas exhaust space 20; and a first gas flow passage 26 extending through an outer circumferential member (bearing sleeve 4) from a surface portion facing at least one first gas exhaust hole 25 to a surface portion located close to the leading end portion of rotary shaft 1.

Figure 5:
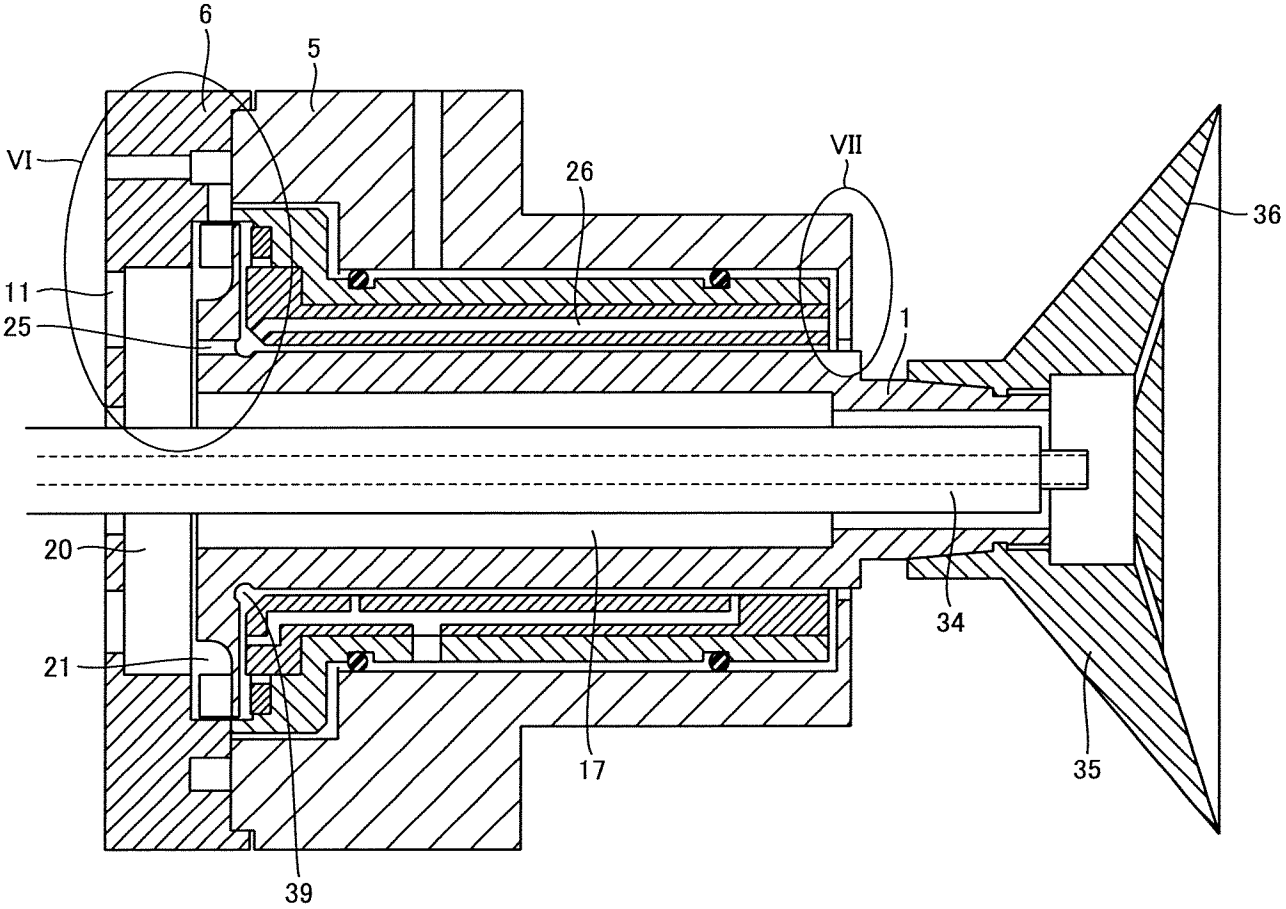
FIG. 5 is a schematic cross-sectional view for illustrating the operation of the spindle according to the first embodiment of the present invention.
Figure 6:
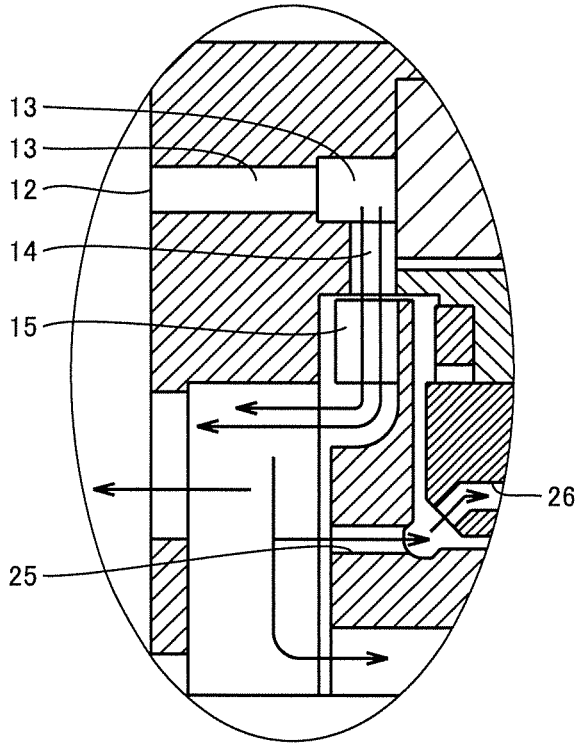
FIG. 6 is an enlarged partial schematic cross-sectional view of a region VI in FIG. 5.
Figure 7:
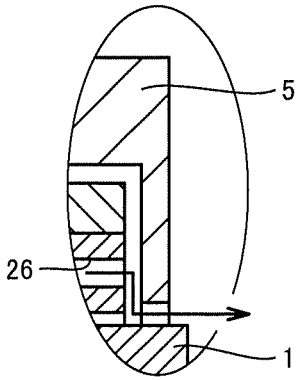
FIG. 7 is an enlarged partial schematic cross-sectional view of a region VII in FIG. 5.

In this way, when the driving gas supplied to rotor blade 15 cannot be sufficiently discharged from gas exhaust space 20 to the outside through gas exhaust hole 11, the driving gas can be discharged from gas exhaust space 20 to the outside through first gas exhaust hole 25 and first gas flow passage 26. Accordingly, it becomes possible to suppress an increase in pressure inside gas exhaust space 20 to thereby prevent inflow of the gas via through hole 17 of rotary shaft 1. The above-described feature will be hereinafter specifically described with reference to FIGS. 5 to 7. FIG. 5 is a schematic diagram for illustrating the effect of the spindle according to the present embodiment. FIG. 6 is a partial schematic cross-sectional view of a region VI in FIG. 5. FIG. 7 is a partial schematic cross-sectional view of a region VII in FIG. 5. In order to simplify the explanation, FIG. 5 shows the spindle having a configuration in which first gas exhaust hole 25 and first gas flow passage 26 are formed close to driving gas supply nozzle 14.

As shown in FIGS. 5 to 7, driving gas is supplied from driving gas supply nozzle 14 to rotor blade 15, as indicated by an arrow in FIG. 6. Then, the driving gas is discharged from gas exhaust space 20 through gas exhaust hole 11 to the outside. In this case, when the driving gas is not sufficiently discharged through gas exhaust hole 11, the pressure of the gas inside gas exhaust space 20 may increase, so that gas may flow from gas exhaust space 20 into through hole 17 of rotary shaft 1.

However, in the spindle according to the present embodiment, first gas exhaust hole 25 is formed in thrust plate portion 22*b* of rotary shaft 1. Thus, the gas inside gas exhaust space 20 is discharged through first gas exhaust hole 25. The gas discharged through first gas exhaust hole 25 then flows through first gas flow passage 26 of bearing sleeve 4 and reaches the front side of rotary shaft 1. On the front side of rotary shaft 1, first gas flow passage 26 is continuous to a gap flow passage between cover 5 and rotary shaft 1. Accordingly, the gas discharged from first gas flow passage 26 is discharged from the front side of rotary shaft 1 through this gap flow passage to the outside, as indicated by an arrow in FIG. 7.

Consequently, the inflow of the gas from gas exhaust space 20 into through hole 17 of rotary shaft 1 can be suppressed, so that the pressure increase inside through hole 17 can be suppressed.

<Modifications>

Figure 8:
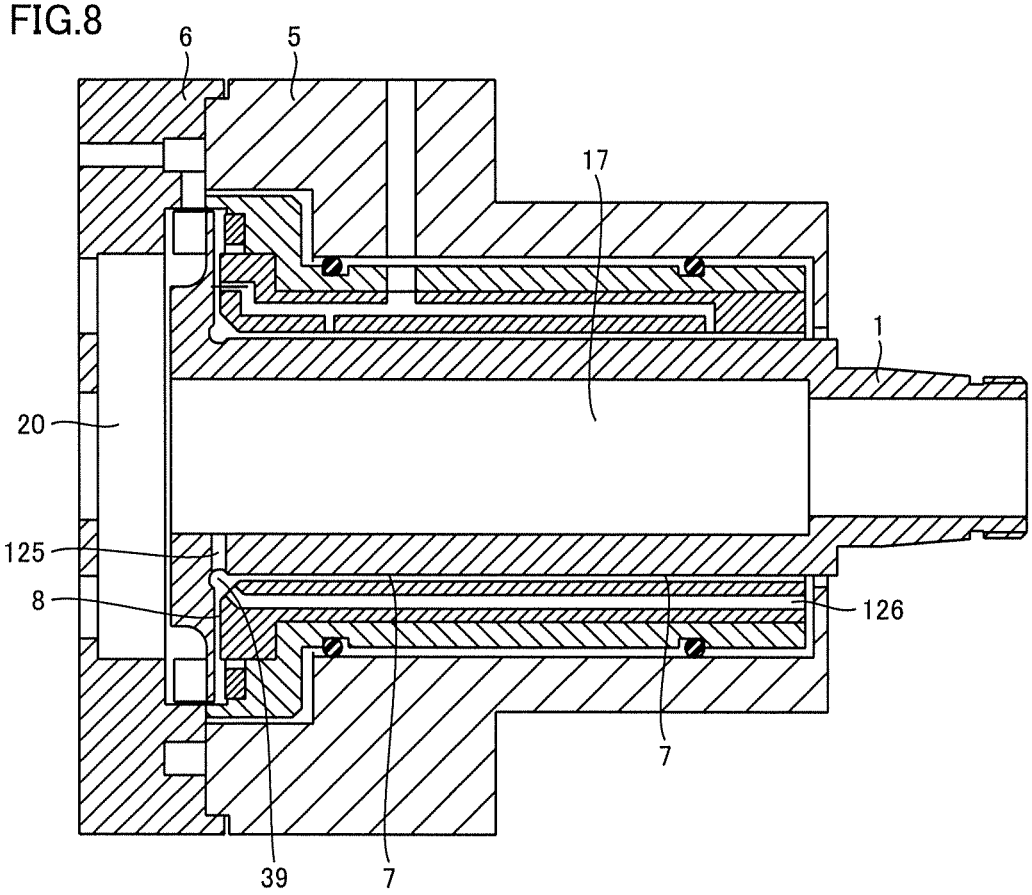
FIG. 8 is a schematic cross-sectional view showing the first modification of the spindle according to the first embodiment of the present invention.

First Modification:

FIG. 8 is a schematic cross-sectional view of a spindle according to the first modification of the present embodiment. The spindle shown in FIG. 8 is basically identical in configuration to the spindle shown in FIG. 1, but different from the spindle shown in FIG. 1 in that a second gas exhaust hole 125 is provided in place of first gas exhaust hole 25 shown in FIG. 1. Specifically, in the spindle shown in FIG. 8, second gas exhaust hole 125 is provided inside through hole 17 of rotary shaft 1 so as to extend in the radial direction toward the outer circumference of rotary shaft 1 from the position close to gas exhaust space 20 relative to the center portion of through hole 17 in the axial direction. Second gas exhaust hole 125 shown in FIG. 8 only has to be provided in the internal space of through hole 17 and located in a region close to gas exhaust space 20 relative to the end portion of bearing sleeve 4 that is close to the leading end portion of rotary shaft 1. In other words, in the spindle shown in FIG. 8, the second gas exhaust portion includes at least one second gas exhaust hole 125 and a second gas flow passage 126. Second gas exhaust hole 125 penetrates through the portion of rotary shaft 1 that faces the gas exhaust region. Second gas flow passage 126 extends through the outer circumferential member (bearing sleeve 4) from the surface portion facing at least one second gas exhaust hole 125 to the surface portion located close to the leading end portion of rotary shaft 1.

Also by such a configuration, the same effect as that of the spindle shown in FIG. 1 can be achieved. In other words, even when the internal pressure in gas exhaust space 20 increases to cause gas to flow from gas exhaust space 20 into through hole 17 of rotary shaft 1, the gas can be immediately discharged through second gas exhaust hole 125 to the outside.

Figure 9:
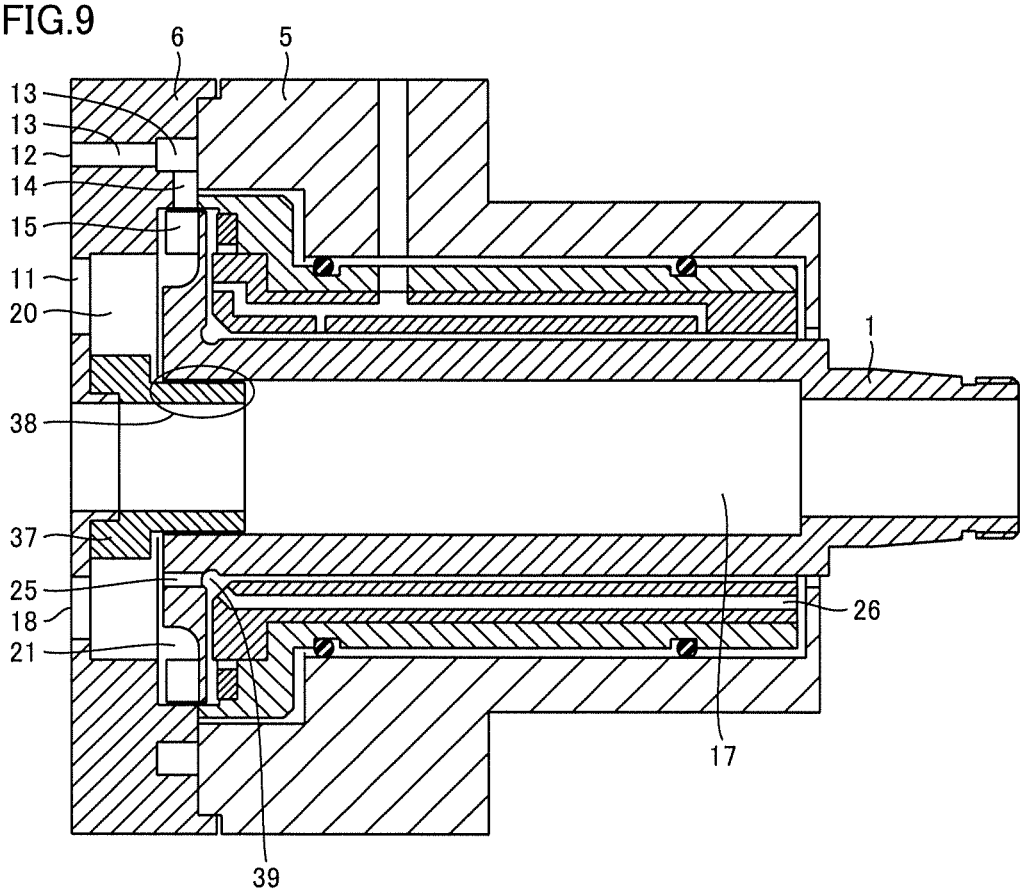
FIG. 9 is a schematic cross-sectional view showing the second modification of the spindle according to the first embodiment of the present invention.

Second Modification:

FIG. 9 is a schematic cross-sectional view of a spindle according to the second modification of the present embodiment. The spindle shown in FIG. 9 is basically identical in configuration to the spindle shown in FIG. 1 but different from the spindle shown in FIG. 1 in that it further includes a sealing member 37 disposed at the connection portion between gas exhaust space 20 and through hole 17. A part of sealing member 37 is being inserted into through hole 17. This part of sealing member 37 is disposed to come in contact with the inner wall of through hole 17 or to face the inner wall with an extremely narrow gap provided therebetween. Thereby, the direct inflow of the gas from gas exhaust space 20 into through hole 17 can be suppressed. First gas exhaust hole 25 is formed at the position spaced apart from sealing member 37. Accordingly, sealing member 37 does not prevent the gas from being discharged through first gas exhaust hole 25.

The spindle having the configuration as described above can achieve the same effect as that of the spindle shown in FIG. 1.

Figure 10:
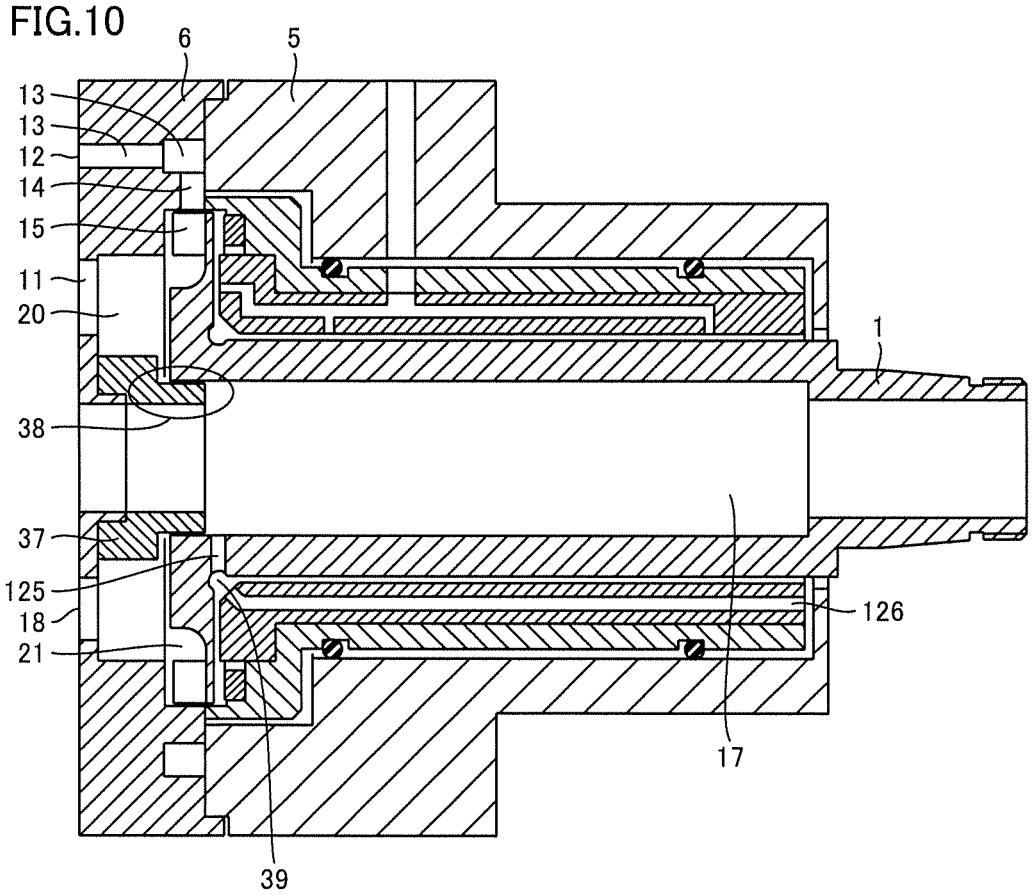
FIG. 10 is a schematic cross-sectional view showing the third modification of the spindle according to the first embodiment of the present invention.

Third Modification:

FIG. 10 is a schematic cross-sectional view of a spindle according to the third modification of the present embodiment. The spindle shown in FIG. 10 is basically identical in configuration to the spindle shown in FIG. 8, but different from the spindle shown in FIG. 8 in that it further includes a sealing member 37 disposed in the connection portion between gas exhaust space 20 and through hole 17. Sealing member 37 is basically identical in configuration to sealing member 37 in the spindle shown in FIG. 9. Furthermore, second gas exhaust hole 125 is located adjacent to sealing member 37 in the axial direction inside through hole 17. In a different point of view, inside through hole 17, second gas exhaust hole 125 is located close to the leading end portion of rotary shaft 1 relative to sealing member 37.

By the configuration as described above, the effect achieved by the spindle shown in FIG. 8 and the same effect as that achieved by the spindle shown in FIG. 9 can be achieved.

Second Embodiment

<Structure of Air Turbine Drive Spindle>

Figure 11:
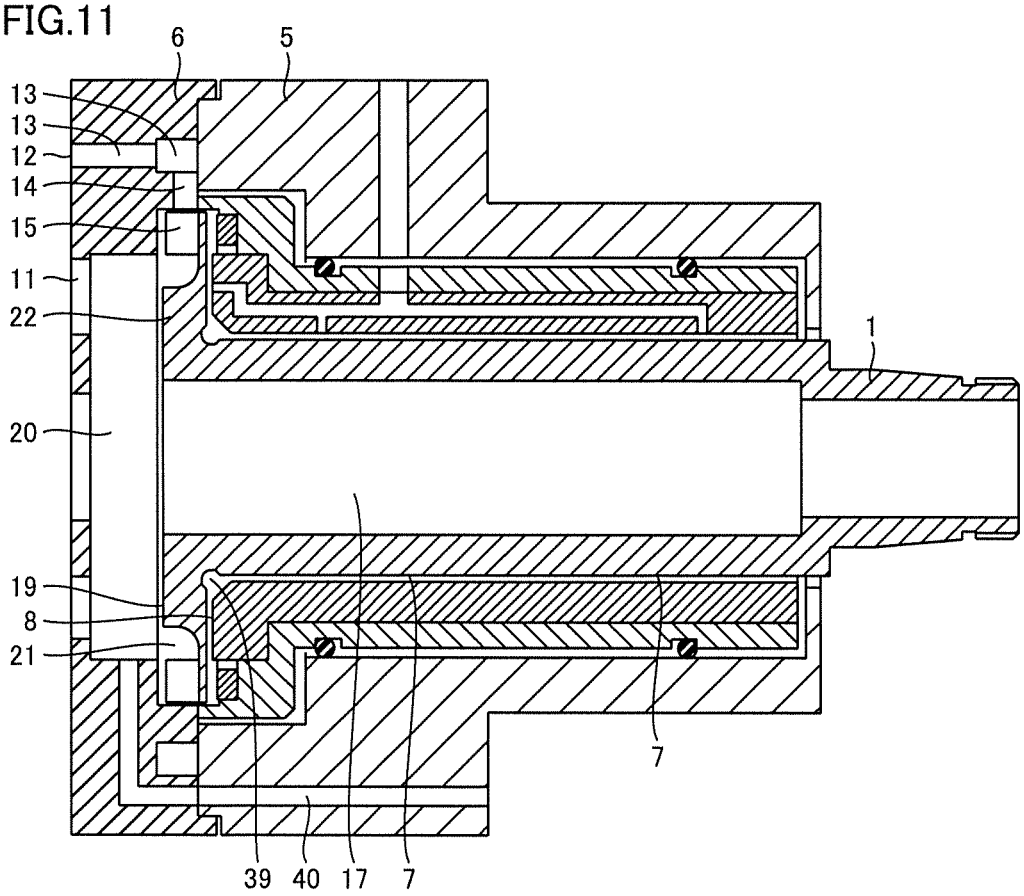
FIG. 11 is a schematic cross-sectional view of a spindle according to the second embodiment of the present invention.

FIG. 11 is a schematic cross-sectional view of a spindle according to the present embodiment. The spindle shown in FIG. 11 is basically identical in configuration to the spindle shown in FIG. 1, but different from the spindle shown in FIG. 1 in the configuration of the gas exhaust hole as the second gas exhaust portion through which gas is discharged from gas exhaust space 20 to the outside. In other words, in the spindle shown in FIG. 11, as the second gas exhaust portion, a third gas flow passage 40 serving as a pressure release hole is provided so as to extend from the surface portion of nozzle plate 6 as an outer circumferential member facing gas exhaust space 20 to the surface portion of the outer circumferential member (cover 5) located close to the leading end portion of rotary shaft 1. Third gas flow passage 40 has one end opened at the inner circumferential surface of gas exhaust space 20 in the radial direction in nozzle plate 6. Furthermore, third gas flow passage 40 extends from its one end on the gas exhaust space 20 side in the radial direction, and then, extends through a bent portion in the axial direction toward the leading end portion of rotary shaft 1. The portion of third gas flow passage 40 extending in the axial direction extends from nozzle plate 6 to cover 5. Third gas flow passage 40 has the other end opened at the surface of cover 5 on the leading end portion side, <Functions and Effects>

Also by the configuration as described above, gas can be directly discharged from the inside of gas exhaust space 20 to the outside through third gas flow passage 40, so that the same effect as that of the spindle shown in FIG. 1 can be achieved. Also, third gas flow passage 40 is formed in nozzle plate 6 and cover 5. Accordingly, the inner diameter and the like of third gas flow passage 40 can be increased without being restricted by the size of rotary shaft 1 unlike first gas exhaust hole 25 formed in rotary shaft 1.

Third Embodiment

<Structure of Air Turbine Drive Spindle>

Figure 12:
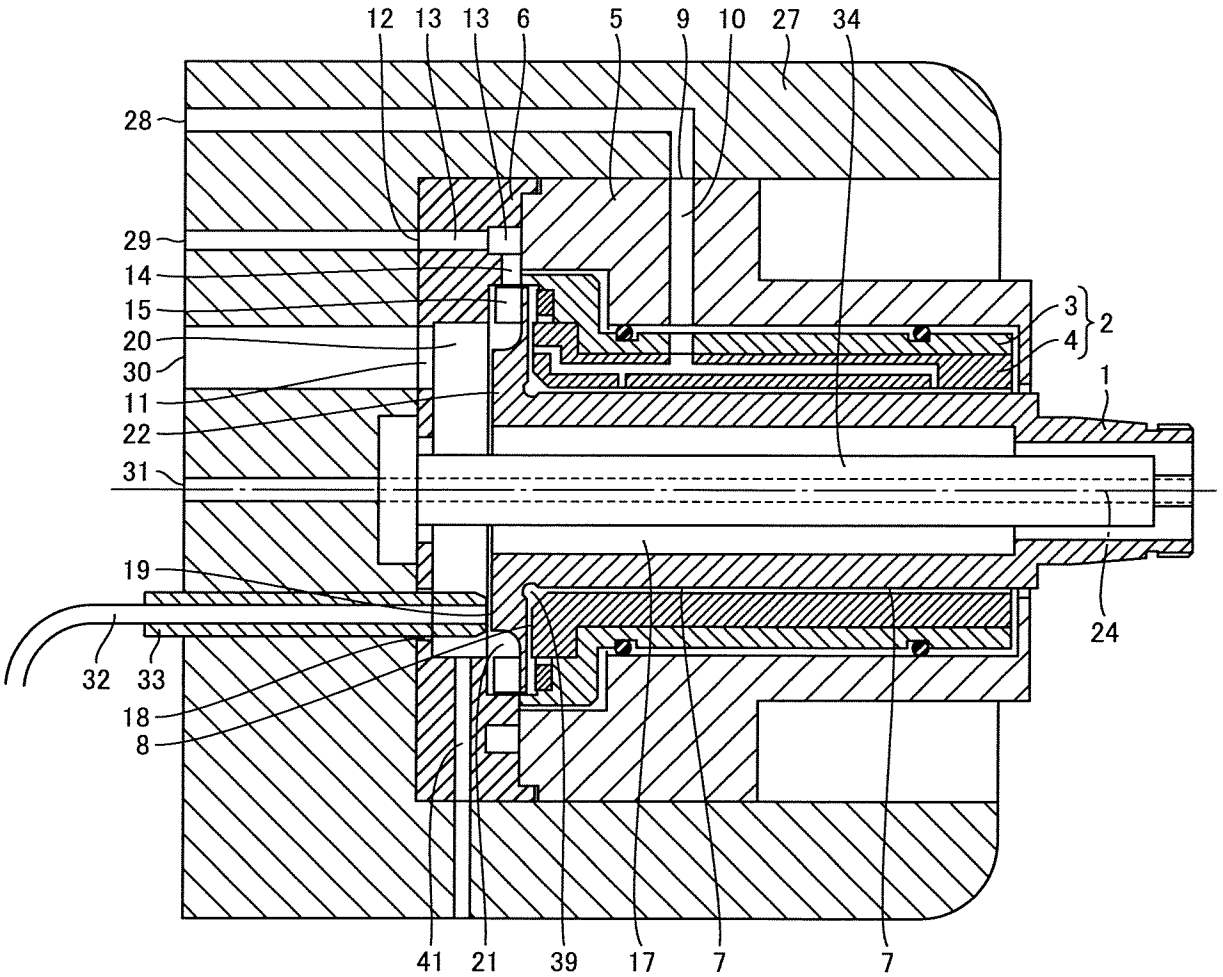
FIG. 12 is a schematic cross-sectional view of a spindle according to the third embodiment of the present invention.

FIG. 12 is a schematic cross-sectional view of a spindle according to the present embodiment. The spindle shown in FIG. 12 is basically identical in configuration to the spindle shown in FIG. 1 but different from the spindle shown in FIG. 1 in the configuration of the gas exhaust hole as the second gas exhaust portion through which gas is discharged from gas exhaust space 20 to the outside. FIG. 12 shows the state where the spindle is held by spindle holder 27 of the coating apparatus.

In the spindle shown in FIG. 12, as the second gas exhaust portion, a fourth gas flow passage 41 is formed so as to extend from the surface portion of the outer circumferential member (nozzle plate 6) facing gas exhaust space 20 to the surface portion of the outer circumferential member (nozzle plate 6) located in the direction toward the side surface (the radial direction) intersecting with the direction in which rotary shaft 1 extends. Fourth gas flow passage 41 is formed so as to extend to spindle holder 27 and reach the outer circumferential surface of spindle holder 27. Fourth gas flow passage 41 has one end opened at the inner circumferential surface of gas exhaust space 20 in the radial direction in nozzle plate 6. Furthermore, fourth gas flow passage 41 extends from its one end on the gas exhaust space 20 side in the radial direction and penetrates through the portions of nozzle plate 6 and spindle holder 27.

<Functions and Effects>

Also by the configuration as described above, gas can be directly discharged from the inside of gas exhaust space 20 through fourth gas flow passage 41 to the outside. Accordingly, the same effect as that of the spindle shown in FIG. 1 can be achieved. Furthermore, fourth gas flow passage 41 is provided in nozzle plate 6 and spindle holder 27. Thus, the inner diameter and the like of fourth gas flow passage 41 can be increased without being restricted by the size of rotary shaft 1 unlike first gas exhaust hole 25 formed in rotary shaft 1.

In addition, the number of each of first gas exhaust hole 25, second gas exhaust hole 125, first gas flow passage 26, second gas flow passage 126, third gas flow passage 40, and fourth gas flow passage 41 described above does not have to be one but may be two or more. Furthermore, when the number of each of the above-mentioned flow passages is more than one, these flow passages may be disposed at regular intervals in the circumferential direction of rotary shaft 1. Furthermore, the total cross-sectional area of at least one first gas exhaust hole 25 may be equal to or less than the total cross-sectional area of at least one first gas flow passage 26. Furthermore, the total cross-sectional area of at least one second gas exhaust hole 125 may be equal to or less than the total cross-sectional area of at least one second gas flow passage 126.

Although the embodiments of the present invention have been described as above, the above-described embodiments may be variously modified. The scope of the present invention is not limited to the above-described embodiments. The scope of the present invention is defined by the terms of the claims, and is intended to include any modifications within the meaning and scope equivalent to the terms of the claims.

INDUSTRIAL APPLICABILITY

The present invention is particularly advantageously applicable to a spindle used in an electrostatic coating apparatus and the like.

REFERENCE SIGNS LIST

1 rotary shaft, 2 housing assembly, 3 housing, 4 bearing sleeve, 5 cover, 6 nozzle plate, 7 journal bearing, 8 thrust bearing, 9, 28 bearing gas supply port, 10 bearing gas supply passage, 11 gas exhaust hole, 12, 29 turbine gas supply port, 13 driving gas supply passage, 14 driving gas supply nozzle, 15 rotor blade, 16 magnet, 17 through hole, 18 rotation sensor insertion hole, 19 rotation detection portion, 20 gas exhaust space, 21 space, 22*a* shaft portion, 22*b* thrust plate portion, 23, 24 O ring, 25 first gas exhaust hole, 26 first gas flow passage, 27 spindle holder, 30 gas exhaust hole, 31 coating material supply hole, 32 optical sensor, 33 sensor holder, 34 coating material spray nozzle, 35 cup, 36 cup surface, 37 sealing member, 39 bearing gas exhaust space, 40 third gas flow passage, 41 fourth gas flow passage, 125 second gas exhaust hole, 126 second gas flow passage.

The invention claimed is:

1. An air turbine drive spindle comprising:

a rotary shaft provided with a through hole, the rotary shaft including a leading end portion, a base end portion located opposite to the leading end portion, and a plurality of rotor blades disposed at the base end portion along a rotation direction of the rotary shaft; and an outer circumferential member including a bearing sleeve configured to surround at least a portion of an outer circumferential surface of the rotary shaft, the outer circumferential member including a gas supply portion configured to spray gas onto each of the plurality of rotor blades so as to rotate the rotary shaft, and a first gas exhaust portion configured to discharge the gas sprayed onto each of the plurality of rotor blades from a gas exhaust space facing each of the plurality of rotor blades to outside of the outer circumferential member, the gas exhaust space that faces the base end portion of the rotary shaft, and is continuous to the through hole of the rotary shaft, the air turbine drive spindle further comprising a second gas exhaust portion that is independent of the first gas exhaust portion, the second gas exhaust portion including at least one gas exhaust hole penetrating through a portion of the rotary shaft to discharge the gas to the outside from the gas exhaust space, wherein the at least one gas exhaust hole being formed in a surface of the rotary shaft that faces the gas exhaust space so that the gas flows in the at least one gas exhaust hole from the gas exhaust space.

2. The air turbine drive spindle according to claim 1, wherein the second gas exhaust portion includes a gas flow passage extending through the outer circumferential member from a surface portion facing the at least one gas exhaust hole to a surface portion located adjacent to the leading end portion of the rotary shaft.

3. The air turbine drive spindle according to claim 2, further comprising a sealing member disposed in a connection portion between the gas exhaust space and the through hole.

4. The air turbine drive spindle according to claim 1, wherein the second gas exhaust portion includes a gas flow passage extending from a surface portion of the outer circumferential member that faces the gas exhaust space to a surface portion of the outer circumferential member located adjacent to the leading end portion of the rotary shaft.

5. The air turbine drive spindle according to claim 1, wherein the second gas exhaust portion includes a gas flow passage extending from a surface portion of the outer circumferential member that faces the gas exhaust space to a surface portion of the outer circumferential member located in a radial direction intersecting with a direction in which the rotary shaft extends.

6. An air turbine drive spindle comprising:

a rotary shaft provided with a through hole, the rotary shaft including a leading end portion, a base end portion located opposite to the leading end portion, and a plurality of rotor blades disposed at the base end portion along a rotation direction of the rotary shaft; and an outer circumferential member including a bearing sleeve configured to surround at least a portion of an outer circumferential surface of the rotary shaft, the outer circumferential member including a gas supply portion configured to spray gas onto each of the plurality of rotor blades so as to rotate the rotary shaft, and a first gas exhaust portion configured to discharge the gas sprayed onto each of the plurality of rotor blades from a gas exhaust space facing each of the plurality of rotor blades to outside of the outer circumferential member, the gas exhaust space that faces the base end portion of the rotary shaft and is continuous to the through hole of the rotary shaft, the air turbine drive spindle further comprising a second gas exhaust portion that is independent of the first gas exhaust portion, the second gas exhaust portion including at least one gas exhaust hole penetrating through a portion of the rotary shaft to discharge the gas to the outside from the gas exhaust space, wherein the at least one gas exhaust hole is formed in an inner surface of the through hole of the rotary shaft so that the gas flows in the at least one gas exhaust hole from the gas exhaust space through the through hole.

7. The air turbine drive spindle according to claim 6, wherein the second gas exhaust portion includes a gas flow passage extending through the outer circumferential member from a surface portion facing the at least one gas exhaust hole to a surface portion located adjacent to the leading end portion of the rotary shaft.

8. The air turbine drive spindle according to claim 7, further comprising a sealing member disposed in a connection portion between the gas exhaust space and the through hole, wherein the at least one gas exhaust hole is located closer to the leading end portion than the sealing member.

9. The air turbine drive spindle according to claim 6, wherein the second gas exhaust portion includes a gas flow passage extending from a surface portion of the outer circumferential member that faces the gas exhaust space to a surface portion of the outer circumferential member located adjacent to the leading end portion of the rotary shaft.

10. The air turbine drive spindle according to claim 8, wherein the second gas exhaust portion includes a gas flow passage extending from a surface portion of the outer circumferential member that faces the gas exhaust space to a surface portion of the outer circumferential member located in a radial direction intersecting with a direction in which the rotary shaft extends.

* * * * *